United States Patent [19]

Fushiki et al.

[11] 4,138,257

[45] Feb. 6, 1979

[54] PROCESS FOR THE TREATMENT OF PHOTOGRAPHIC MATERIALS

[75] Inventors: Isamu Fushiki; Sigeharu Koboshi; Sadatugu Terada, all of Hino, Japan

[73] Assignee: Konishiroku Photo Industry Co., Ltd., Tokyo, Japan

[21] Appl. No.: 792,559

[22] Filed: May 2, 1977

[30] Foreign Application Priority Data

May 4, 1976 [JP] Japan ..... 51-49875

[51] Int. Cl.[2] ..... G03C 5/38; G03C 5/32

[52] U.S. Cl. ..... 96/60 BF; 96/61 R

[58] Field of Search ..... 96/61 R, 61 M, 50 R, 96/60 R, 62

[56] References Cited

U.S. PATENT DOCUMENTS

| | | | |
|---|---|---|---|
| T881,006 | 12/1970 | Bard | 96/60 R |
| T910,002 | 5/1973 | Holter | 96/60 R |
| 3,238,043 | 3/1966 | Levy | 96/61 R |
| 3,607,277 | 9/1971 | Schranz et al. | 96/61 R |
| 3,770,437 | 11/1973 | Brugger et al. | 96/60 R |
| 3,880,660 | 4/1975 | Ishihara et al. | 96/61 R |
| 4,040,837 | 8/1977 | Sakamoto et al. | 96/60 BF |

FOREIGN PATENT DOCUMENTS

| | | | |
|---|---|---|---|
| 1051117 | 2/1959 | Fed. Rep. of Germany | 96/60 BF |

*Primary Examiner*—Mary F. Kelley

*Attorney, Agent, or Firm*—Haseltine, Lake & Waters

[57] ABSTRACT

In the processing of developed imagewise exposed silver halide photographic material with a solution having fixing ability, the fixing efficiency is improved and environmental pollution prevented by employing a solution containing bromine ions or iodine ions as the fixing agent and incorporating in said solution or in a post-bath solution, a polymer having in its molecular structure pyrrolidone nucleus units and a molecular weight of about 2,000 to 500,000.

10 Claims, No Drawings

PROCESS FOR THE TREATMENT OF PHOTOGRAPHIC MATERIALS

This invention relates to a process for the treatment of a light-sensitive silver halide photographic material, which process involves a step of processing said photographic material with a photographic processing solution having fixing ability and particularly to a process for the treatment of the photographic material using a specific halogen ion as a fixing agent. More particularly, the invention is concerned with a process for the treatment of the photographic material, by which the requisites for the prevention of environment pollution can be met, the fixing efficiency as well as the bleach-fixing efficiency attained when the photographic processing solution used is the so-called bleach-fixing solution, is found excellent and an excellent silver image or color dye image may be obtained in addition that no opacification of the processed photographic material is seen even when the photographic material to be processed is a light-sensitive silver halide photographic material with a high silver content and that no degradation of the fixing ability is seen even when the photographic processing solution having fixing ability, which has been once used, is subjected to silver-recovering treatment and then to regeneration treatment for the purpose of reusing the processing solution as a photographic processing solution having fixing ability.

In obtaining a silver image or a color dye image formed on a light-sensitive silver halide photographic material which has been exposed to light followed by development treatment, generally the developed photographic material is subjected to a fixing treatment. That is, in the case where a light-sensitive silver halide photographic material used is for use in black-and-white photography, a silver image is obtained on the exposed photographic material by development treatment and then unexposed silver halide remaining on the developed photographic material is dissolved and removed by a fixing treatment, thereby recording only the silver image on the thus treated photographic material. In the case where a light-sensitive silver halide photographic material used is for use in color photography, on the other hand, it is a common practice that in case the photographic material is of the positive type, said material is subjected to a first development treatment and, in case the material is of the negative type, said material is subjected, as it is, to color development treatment to develop a silver image thereon, the developed silver image is bleached with an oxidizing agent (bleaching agent) to a soluble silver salt and then all the soluble silver salt is dissolved and removed by fixing treatment, thereby recording a color dye image on the thus treated photographic material. In addition to the treatment method in which bleaching and fixing are individually carried out in separate treatment steps as in the manner mentioned above, there is also adopted a treatment method known as bleach-fixing wherein the treatment steps are simplified for the purpose of quick treatment, and elimination or reduction of excess labor to complete the bleaching and fixing treatments simultaneously in one step.

Usable as silver halide fixing agents in these desilvering steps are known compounds such as thiosulfate, thiocyanate, halogen salts, thiourea, thioglycol and thiol compounds. In the actual practice of photographic treatment, however, thiosulfate is used as the fixing agent in most cases from the standpoint of the stability of silver complex salt, cost and other factors. In the practice of fixing treatment even when any of these compounds is used as the fixing agent, the remaining silver salt is dissolved and removed by use of a compound by which the reaction between sodium thiosulfate, i.e., an ingredient of the fixing solution, and silver halide is brought about to form a soluble complex salt. For example, in the case where sodium thiosulfate is used as the ingredient of the fixing solution, the reaction is believed to proceed according to the following reaction scheme:

$$AgX + n(NH_4)_2S_2O_3 \rightarrow Ag(S_2O_3)_n^{\ominus(2n-1)} + 2nNH_4^{\oplus} + X^{\ominus}$$

wherein n represents 2 or 3 and X represents halogen.

As is seen in the above reaction scheme, the silver complex salt and halogen ion are accumulated in the fixing solution with the progress of fixing treatment of a light-sensitive silver halide photographic material and, at the same time, the free ingredient of the fixing solution becomes reduced in its amount. During the progress of this reaction, the fixing efficiency is gradually lowered, and when the fixing treatment is continued in this way, a phenomenon of fatigue comes to be observed and the fixing solution thus used is eventually no longer used. On this account, there has been adopted a method in which a suitable amount of a fresh fixing solution (a regenerating agent or a replenisher) replenishes the fatigued fixing solution in order to revive said fatigued fixing solution and simultaneously the fatigued fixing solution is discharged as an over-flow out of the sytem. Disposal of this overflow as it is, however, is simply a waste of silver and other valuable components contained in said over-flow from the viewpoint of protection of resources and is also economically disadvantageous and disagreeable to anyone from the viewpoint of environment pollution. On that account, the overflow liquid to be disposed as waste must be subjected to a treatment for making said liquid perfectly harmless.

In this respect, heretofore disposal of the overflow fixing solution has frequently been practiced after recovering silver ion from the solution containing the same. Recently, however, there has come to be adopted a much advanced treatment wherein the fixing solution after recovering silver therefrom is regenerated and then used again and again by repetition of regeneration of such fixing solution. For instance, in the case where the recovery of silver from the fixing solution is carried out according to the electrolytic process which is most advantageously adopted as a silver-recovering process, a thiosulfate ion bonded to a silver ion is liberated again and consequently said fixing solution is restored in its fixing ability but, on the other hand, the amount of the thiosulfate ion is reduced due to this electrolytic reaction and also due to air-oxidation or the so-called carry over at the time of the treatment. It is a common practice, therefore, to regenerate and use again repeatedly the once used fixing solution while replenishing said fixing solution with a fresh fixing solution (a regenerating agent or a replenisher) having its concentration capable of retaining necessary amounts of ingredients of the fixing solution, the liquid amount of said fresh fixing solution being such as to cause no over-flowing. Even when the fixing solution is repeatedly used by regeneration according to such replenishing process, however, the fixing efficiency gradually varies in proportion to frequency of use so as to lower the fixing speed in spite of a sufficiently high concentration of the free thiosulfate ion in the fixing solution, and eventually the fixing treatment becomes unsatisfactory. The cause of such trouble is considered ascribable to the fact that soluble components contained in an emulsion layer of the light-sensitive photographic material to be processed become eluted into the fixing solution to accumulate components inhibitory to the fixing ability of the fixing solution. As a means of avoiding such troubles, there has been proposed a process in which a fixing promotor is added to a fixing solution to enhance the fixing power of said solution and a process in which halogen ion believed to be a fixing-inhibitory component is removed from the fixing solution containing same. That is, as an example of the former process, there is disclosed in Japanese Patent Publication No. 35754/1970 a process for the promotion of fixing by means of a sulfur compound or in Japanese Patent Publication No. 39173/1973 a process for the promotion of fixing by means of a polyethylene glycol type compound. Neither of these processes are sufficient as a fundamental means of avoiding the trouble of unsatisfactory fixing due to accumulation of a halogen ion and the like believed to be a fixing-inhibitory component in the fixing solution, and each process has such drawbacks that the unsatisfactory fixing is eventually brought about in the due course of repetition of regeneration and re-use of the fixing solution. Accordingly, it is the present state of the art that the fixing solution is regenerated and re-used while discarding a part of over-flowing fixing solution in order to lower the concentration of the accumulating and converging halogen ion and no solution of the problem of public nuisance as well as of poor economy has been brought about yet. As an example of the latter process, on the other hand, there are disclosed in U.S. Patent Disclosure No. B-391509, Japanese Patent Publication No. 30167/1968, etc. a halogen ion removing techniques achieving effects of increasing fixing power. Each of these techniques, however, has such drawbacks that an apparatus of complex structure is needed and both equipment and operation costs become great.

In either case, it may be said that thiosulfate which is frequently used as a fixing agent incurs a strong possiblity of environmental pollution and has a serious drawback from the standpoint of prevention of public nuisance.

In the case of thiocyanates and halogen salts which are known as fixing agents other than the abovementioned thiosulfates, on the other hand, there are such drawbacks that because of its low stability, the silver salt decomposes when the concentration of fixing agent becomes low in the following water-washing step or the like and remains as silver thiocyanate or silver halide in an emulsion layer of the photographic material to be processed, whereby the finished negative or positive film obtained after being thus processed becomes opaque. Therefore, it is the present state of the art that thiocyanates and halogen salts are scarcely put to practical use when they are intended to be used singly. The present inventors have found that such drawbacks as mentioned above may be removed by the use of at least a definite amount of thiosulfate in combination with thiocyanate or a halogen salt. In that case, however, the amount of thiosulfate used in a fixing solution is usually around 0.2 mol/l, and when a part of the fixing solution is discarded as an over-flow liquid, as mentioned previously, at the time of re-using said fixing solution repeatedly while effecting silver-recovery, no biological oxygen demand (B.O.D.) as well as chemical oxygen demand (C.O.D.) can be met and there is the possibility of bringing about environmental pollution. In addition, the fixing solution is liable to decomposition by oxidation because thiosulfate is, per se, a reducing agent, and thus there is brought about a serious disadvantage when the fixing solution is intended to be regenerated and then re-used. Furthermore, when the above-mentioned thiosulfate is used as a fixing component of a bleach-fixing solution having both fixing and bleaching abilities, there is brought about such drawback that, because thiosulfate is, per se, a reducing agent and sulfite which is necessary as an agent for maintaining a constant state of thiosulfate is also a reducing agent, the oxidation-reduction potential of the bleach-fixing solution becomes small and degrades the oxidizing power of the co-existing oxidizing agent, whereby regeneration and re-use of said bleach-fixing solution become difficult. Such drawbacks entailed by the presence of thiosulfate is a problem which may be observed likewise when thiosulfate is used alone as a fixing component in the bleach-fixing solution. In this light, also, it is the present state of the art that development of a process for the treatment of photographic material using a fixing solution or a bleach-fixing solution containing no thiosulfate is strongly demanded.

Well aware of the foregoing points, the present inventors have succeeded in accomplishing the present invention, and a primary object of the present invention is to provide a process for the treatment of silver halide photographic materials, by which the demand of prevention of environmental pollution can be met and in which the burdens to the biological oxygen demand and the chemical oxygen demand are light and the problem of toxicity can be fairly solved.

A secondary object of the present invention is to provide a process for the treatment of silver halide photographic materials, by which an excellent fixing efficiency or bleach-fixing efficiency can be attained and, even when the photographic material to be treated thereby is a highsilver content silver halide photographic material, an excellent silver image or color dye image can be obtained in the finished photographic material where no opacification of said finished photographic material is observed.

A third object of the present invention is to provide a process for the treatment of silver halide photographic materials, in which a fixing or bleach-fixing solution does not undertake the influence of fixinginhibitory components which are eluted from emulsion layers or the like of the photographic material treated thereby and accumulate in said solution and, even when the fixing or bleaching solution is regenerated and re-used repeatedly, the regenerated fixing or bleach-fixing solution can bear increased frequency of use without the degrading fixing or bleach-fixing ability thereof.

A fourth object of the present invention is to provide a process for the treatment of silver halide photographic materials, in which the oxidation-reduction potential of a bleach-fixing solution having bleach-fixing ability in addition to fixing ability is not decreased and the oxidizing ability of the co-existing bleaching agent (an oxidizing agent) can be sufficiently exhibited when a photographic material is treated with said bleach-fixing solution.

The present inventors have found that in a process for the treatment of a silver halide photographic material involving a step of treating said photographic material in a photographic processing bath having fixing ability and containing at least 3 moles/l of bromine ion or at least 1.3 moles/l of iodine ion, the aforesaid object of the present invention can be accomplished by incorporating into said processing bath and/or a processing bath subsequent thereto a polymer having, in the molecular structure, pyrrolidone nucleus units.

That is, in the process for the treatment of photographic materials according to the present invention, a specific member of halogen ions is used in a specific amount or more in a photographic processing bath and, at the same time, no thiosulfate having such drawbacks as mentioned previously is present in said processing bath, thereby to accomplish the aforementioned objects.

In the present invention, the step of treating a silver halide photographic material in a photographic processing bath having fixing ability is intended to designate both a step of using a processing bath containing a bleach-fixing solution and a step of using a processing bath containing a fixing solution and, in this connection it is added that a processing solution having fixing ability includes a bleach-fixing solution containing such bleaching agent (an oxidizing agent) as a metal complex salt of aminopolycarboxylic acids, potassium ferricyanide or ferric salt and having bleaching ability in addition to fixing ability and an ordinary fixing solution having no bleaching ability. Accordingly, typical examples of the photographic processing bath having fixing ability in accordance with the present invention include a mere fixing bath, an acidic fixing bath, a film-hardening fixing bath and a bleach-fixing bath and, in addition thereto, any photographic processing baths are included therein as long as they have fixing ability. The treatment of photographic materials by means of such photographic processing baths as mentioned above may be a single treatment step or may be carried out independently in a plurality of divided stages, for example, in the treatment of a light-sensitive silver halide color photographic material, the developed material is bleached after the first fixing treatment and then is subjected again to fixing treatment.

Halogen ions to be incorporated into the photographic processing bath having fixing ability according to the present invention are limited only to a bromine ion and an iodine ion, which ions are supplied to the processing solution of said bath by means of soluble bromide or soluble iodide. Halogen compounds used for providing halogen ion into the said bath may be either inorganic or organic salts so long as these salts are bromides or iodides. Typical examples of the bromides and iodides usable in the present invention include hydrobromide, lithium bromide, sodium bromide, potassium bromide, ammonium bromide and sodium iodide, potassium iodide, ammonium iodide, etc., and particularly preferably ammonium and potassium salts which are high in diffusion speed into gelatin layers of a photographic material to be treated. These halogen compounds may be used either singly or in combinations of two or more kinds of these compounds, provided that when a bromide is used in combination with an iodide, at least one of the two is required to satisfy by itself alone the aforesaid concentration in a photographic processing bath. In that case, moreover, better results can be obtained when both the bromide and iodide individually satisfy their concentrations as aforesaid. In the present invention, a chlorine ion and a fluorine ion resulting from chlorides and fluoride are excluded from the scope of the halogen ion defined in the present invention, because the action and effect expected in the present invention cannot be exhibited. However, no influence is exerted on the action and effect of the present invention even when both chlorine and fluorine ions are contained in a photographic processing bath so long as said bath is incorporated with a bromine or iodine ion having the aforesaid concentration.

It is an essential requisite for the present invention that the photographic processing bath having fixing ability is incorporated with, based on 1 l of said bath, at least 3 moles of bromine ion or at least 1.3 moles of iodine ion, thereby to accomplish sufficiently the aforesaid objects of the present invention. From the standpoint of solubility, however, the upper limit of the bromine ion concentration is about 7.5 mole/l and that of the iodine ion concentration is about 12 moles/l. In the present invention, the amount of ion to be added is particularly preferably 4–6 moles/l in the case of bromine ion and 1.5–6 moles/l in the case of bromine ion for the purpose of maintaining the viscosity of the processing solution at a low level and, at the same time, increasing treatment efficiency by maintaining the diffusing speed of components of the processing solution at a high level.

The polymer having in the molecular structure pyrrolidone nucleus units (hereinafter simply called "the present polymer" or "the polymer used in the present invention") includes all polymeric polymers in which the main or side chain of the polymer unit has been substituted by pyrrolidone nuclei at any positions with any number of said nuclei, and said polymer may be either a homopolymer or a copolymer obtained by polymerizing two or more copolymerizable components. In the case of the copolymer, a polymer having, in the molecular structure, pyrrolidone nucleus units, which polymer is a copolymer component of said copolymer, is desirably contained in an amount of more than 20%, preferably more than 30%, in said copolymer obtained by copolymerizing said copolymer component polymer with another polymer copolymerizable therewith but having no pyrrolidone nucleus unit in the molecular structure. As the other polymer copolymerizable with a copolymer component polymer having in the molecular structure pyrrolidone nucleus units, there may be used any polymers so long as a hydrophilic copolymer may be obtained by copolymerization with said copolymer component polymer having in the molecular structure pyrrolidone nucleus units. The present polymer is generally 2,000–500,000, preferably 5,000–50,000 in molecular weight.

Typical examples of the polymer used in the present invention may include those as exemplified below.

In the examples, "M. W." means "molecular weight".

[1] Poly-N-vinyl-2-pyrrolidone (* Note 1) (M.W. 10,000)

[2] Poly-N-(2-acryloyloxy)ethyl-1-pyrrolidone (M.W. 35,000 )

[3] Poly-N-glycidyl-2-pyrrolidone (M.W. 2,500)

[4] Poly-N-allyl-2-pyrrolidone (M.W. 5,000)

[5] Poly-N,N-dimethyl-N-[3(1-pyrrolidonyl)-2-hydroxy]-propyl-amine-N'-acryloylimine (M.W. 40,000)

[6] Copoly-N-vinyl-2-pyrrolidone/N-acryloylmorpholine (mol ratio; 42:58) (M.W. 25,000)

[7] Copoly-N-vinyl-2-pyrrolidone/N-acryloylpiperidine (mol ratio; 35:65) (M.W. 30,000)

[8] Poly-N-vinyl-2-pyrrolidone/N-methyacryloyl-2-methylimidazole (mol ratio; 55:45) (M.W. 45,000)

[9] Copoly-N-(2-acryloyloxy)-ethyl-2-pyrrolidone/diethylamide acrylate (mol ratio; 60:40) (M.W. 50,000)

[10] Copoly-N-(2-methacryloyloxy)ethyl-2-pyrrolidone/sodium acrylate (mol ratio; 75:25) M.W. 33,000)

[11] Copoly-N-(3-acryloyloxy)propyl-2-pyrrolidone/-methyl methacrylate (mol ratio; 65:35) (M.W. 25,000)

[12] Copoly-N,N-dimethyl-N-[3-(1-pyrrolidonyl)-2-hydroxy]-propylamine-N'-acryloylimine/ethyl acrylate (mol ratio; 70:30) (M.W. 15,000)

[13] Copoly-N-vinyl-2-pyrrolidone/vinyl acetate (mol ratio; 70:30) (M.W. 20,000)

[14] Copoly-N-vinyl-2-pyrrolidone/methyl acrylate (mol ratio; 70:30) (M.W. 38,000)

[15] Copoly-N-vinyl-2-pyrrolidone/styrene (mol ratio; 80:20) (M.W. 22,000)

[16] Copoly-N-vinyl-2-pyrrolidone/acrylic acid amide/N-vinyl-2-methylimidazole (mol ratio; 50:30:20) (M.W. 18,000)

[17] Copoly-N-vinyl-2-pyrrolidone/N-(1,1-dimethyl-3-oxo)-butylacrylamide (mol ratio; 70:30) (M.W. 30,000)

[18] Copoly-N-allyl-2-pyrrolidone/vinyl acetate (mol ratio; 64:36) (M.W. 16,000)

[19] Copoly-N-vinyl-2-pyrrolidone/4-vinylpyridine (mol ratio; 60:40) (M.W. 24,000)

[20] Copoly-N-vinyl-2-pyrrolidone/ethyl acrylate/acrylic acid monoethanolamine salt (mol ratio; 50:45:5) (M.W. 27,000)

[21] Copoly-N-vinyl-2-pyrrolidone/-piperidinomaleamic acid piperidine salt (mol ratio; 53:47) (M.W. 15,000)

[22] Copoly-N-vinylpyrrolidone/4-vinylpyridino-N-methyl iodide (mol ratio; 42:58) (M.W. 33,000)

[23] Copoly-N-vinylpyrrolidone/maleic acid thiourea half ammonium salt (mol ratio; 60:40) (M.W. 12,000)

Polymer [1] indicated by *Note 1 is produced and sold by General Aniline and Film Corp. under the trade names of PVPK-15 (M.W. 10,000),PVPK-30 (M.W. 40,000) and PVPK-90 (M.W. 360,000).

As mentioned above, a part of the polymers used in the present invention are readily available because they are being sold on the market and each of the remainder may be easily synthesized according to a process disclosed by W. R. Sorenson and T. W. Campbell, in "Preparative Methods of Polymer Chemistry", from John Wiley and Sons, Inc., 1961.

The polymer used in the present invention is incorporated into the aforesaid photographic processing bath having fixing ability and/or a processing bath subsequent thereto. When the photographic processing bath having fixing ability is incorporated with the present polymer, the processing bath subsequent thereto may also be incorporated with the present polymer. In that case, however, it does not follow that more preferable effects may be obtained as compared with the case where only the photographic processing bath having fixing ability is incorporated with the present polymer. It is therefore not an essential requisite of the present invention to incorporate the present polymer into the processing bath subsequent to the photographic processing bath having fixing ability. In case the photographic processing bath is not desirable to be incorporated with the present polymer, the processing bath subsequent thereto is incorporated with the present polymer. In this case, such post-treatment bath is preferably used immediately after the photographic processing bath having fixing ability, i.e. a fixing bath or bleach-fixing bath, but other treatment step such as rinse treatment may be interposed between the fixing bath or bleach-fixing bath and the post-treatment bath. As mentioned previously, when the photographic processing bath having fixing ability is incorporated with the present polymer, any processing bath subsequent thereto may optionally incorporated with the present polymer. In case such post-treatment bath solution is incorporated with the present polymer, this post-treatment solution may also be coated, according to coating technique using sponge or the like, on the photographic material to be treated thereby.

The amount of the present polymer to be added may vary according to the case where the present polymer is incorporated into the photographic processing bath having fixing ability and to the case where the present polymer is incorporated into the post-treatment bath. In the former case, the amount of the present polymer to be incorporated is generally 5–200 g/l, and in the case where a silver ion is eluted from an emulsion layer of the photographic material to be treated and accumlated in said photographic processing bath, for example, in case such large amount of silver ion as 45 g/l has been accumulated in said bath, the amount of the present polymer is sufficiently 30–80 g/l. The amount of the present polymer to be incorporated may be suitably decided irrespective of the above-mentioned amount range, taking into account the treatment temperature employed in the said photographic processing bath, the kind of the present polymer used and the concentration of the co-existing bromine or iodine ion as a fixing agent in addition to the above-mentioned consideration. Generally, when the amount of the present polymer to be incorporated is excessively small, deposition of silver halide due to decomposition of a silver halide complex is liable to occur in a water-washing step employed as the post-treatment. If the said amount is larger than necessary, care is needed not only because the processing solution increases in viscosity thereby exerting an adverse influence on treatment speed but also because a decrease in the amount of components of said solution due to carry over is observed. In the latter case where the present polymer is incorporated into the post-treatment bath subsequent to the photographic processing bath having fixing ability, the amount of said polymer to be incorporated is generally 5–400 g/l, preferably 20–200 g/l, since there is no such elution of large amounts of silver ion as in the case of the aforesaid photographic processing bath having fixing ability. In this case, however, it is desirable to decide experimentally, without being limited to the above-mentioned range, the amount of the present polymer to be incorporated so that precipitation of the silver halide in the water-washing step does not take place.

The bath into which the present polymer is incorporated may further be incorporated according to the kind of bath employed with various additives. For example, there may be added, into such bath, appropriate amounts of additives such as constant state-retaining agents, development promotors, development inhibitors, alkali agents, pH regulators, buffers and film hardening agents.

In incorporating the present polymer into the photographic processing bath having fixing ability, the polymer is preferably incorporated directly into said bath as mentioned previously. In this case, however, the present polymer may be incorporated into a pre-treatment bath prior to said photographic processing bath and then said polymer is allowed to be added due to carry in caused by the photographic material treated thereby to the photographic processing bath having fixing ability. Alternatively, there may be adopted such a process in which the present polymer is incorporated into the photographic material to be treated and said polymer is allowed to ooze out from said photographic material during treatment in the photographic processing bath having fixing ability and to accumulate in said bath. In the case of the above process, however, it is necessary that the volume of the photographic material to be treated thereby is sufficient to maintain a concentration of the present polymer in the photographic processing bath having fixing ability at the predetermined level or higher. Thus, this process is not always said to be preferable.

The photographic processing bath having fixing ability and/or the post-treatment bath into which the present polymer is incorporated is preferably operated at elevated temperature. The higher is the temperature, the faster is the treatment speed, and the difference between the clearing time required by the use of a fresh processing solution and that required by the use of the fatigued processing solution after treatment of a large number of photographic materials becomes small. It is also preferable to carry out the treatment of photographic material in the bath at a temperature as high as possible, because said bath is less apt to be subject to an adverse effect of fixing-inhibitory components which ooze out from the photographic material to be treated thereby and accumulate in said bath, and thus this is of advantage at the time of regeneration and re-use of the fatigued processing solution. In some cases, however, the treatment temperature above 60° C. is not generally desirable in the light of an apparatus used in the treatment or the type of photographic material to be treated, particularly heat resisting property of a support for said photographic material, and film properties of said photographic material. Accordingly, the treatment is usually carried out within the temperature range of 20° to 55° C.

The pH of the photographic processing bath having fixing ability according to the present invention and the bath into which the present polymer is incorporated may be optionally decided. In case the said processing bath contains a fixing solution, however, the pH of said solution is generally 3–10, preferably 4–9, because if the pH is excessively low, a bromine or iodine ion as a fixing agent is liable to oxidation and, on the other hand, if the pH is excessively high, gelatin layers of the photographic material to be treated become excessively swelled in some cases. In the case where the processing solution employed is a bleach-fixing solution, the pH of the solution is preferably low because there is observed such tendency that the lower is the pH, the smaller is the clearing time. On the other hand, however, if the pH of the solution is excessively low, there is sometimes brought about such a problem that a coupler used in the photographic material to be treated forms, depending on the kind of coupler used, a dye image in the form of a leuco body, the recoloring degree of which becomes small. Thus, the pH of the bleach-fixing solution is generally in the range of 4–8.5, desirably in the range of 5.5–7.5. In the case where the present polymer is used in the post-treatment bath subsequent to the photographic processing bath having fixing ability, the pH of said post-treatment bath is desirably in the range of 3–10, more preferably in the range of 4–9.

As mentioned previously, the photographic processing bath is roughly divided into a fixing bath and a bleach-fixing bath. The fixing solution used in the former fixing bath may have any composition so long as it is incorporated with a bromine ion or iodine ion as a fixing agent in the range of concentration as previously mentioned. As the most simple fixing solution usable in the present invention, there may be mentioned a fixing solution incorporated with a bromine ion alone, a fixing solution incorporated with an iodine ion alone, a fixing solution incorporated with both bromine and iodine ions and these fixing solutions individually incorporated with the present polymer. The above-mentioned fixing solution may be incorporated, if necessary, with various photographic additives either singly or in combination of two or more. For instance, the fixing solution may be incorporated with such pH buffer agents, either singly or in combination of two or more, as boric acid, borax, sodium hydroxide, potassium hydroxide, sodium carbonate, sodium bicarbonate, potassium bicarbonate, potassium bicarbonate, acetic acid, sodium acetate and ammonium hydroxide. The fixing solution may also be incorporated suitably with various fluorescent brightening agents, defoaming agents, surface active agents, stabilization promoting agents or constant state retaining agents such as sulfurous acid, hydroxylamine, hydrazine, bisulfate and addition products of aldehyde compounds, organic chelating agents such as aminopolycarboxylic acids and the like, certain kind of stabilizers such as nitroalcohol nitrate, or organic solvents such as methanol, dimethylformamide and the like.

The bleach-fixing solution used in the latter bleach-fixing bath contains a bleaching agent (an oxidizing agent) in addition to the aforesaid fixing component, which bleaching agent may be optionally selected from various agents. For example, typical examples of the bleaching agent usable in the present invention include ferricyanides such as potassium ferricyanide, sodium ferricyanide and ammonium ferricyanide, persulfate, bichromate, metal complex salts of aminopolycarboxylic acids and metal salts of polycarboxylic acids. From the standpoint of prevention of public nuisance, the bleaching agents which are particularly desirably used in the present invention are the metal complex salts of organic acids. As the organic acids usable for the preparation of bleaching agent, there may be mentioned such aminopolycarboxylic acids as represented by the following general formula (I) or (II):

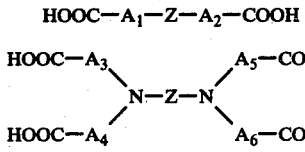

General formula (I)

General formula (II)

wherein $A_1$, $A_2$, $A_3$, $A_4$, $A_5$ and $A_6$ individually represents a hydrocarbon group which include substituted or unsubstituted hydrocarbon, and Z represents a hydrocarbon group, oxygen, sulfur or $> N\text{-}A_7$ (where $A_7$ is a hydrocarbon group or a lower aliphatic carboxylic acid residue). The hydrocarbon group includes substituted or unsubstituted hydrocarbon.

The above-mentioned aminopolycarboxylic acids may be in the form of alkali metal salt, ammonium salt or watersoluble amine salt. Typical examples of the aminopolycarboxylic acids represented by the general formula (I) or (II) may include those mentioned below.

(1) Ethylenediamine tetraacetic acid
(2) Diethylenetriamine pentaacetic acid
(3) Ethylenediamine-N-(β-oxyethyl)-N,N',N'-triacetic acid
(4) Propylenediamine tetraacetic acid
(5) Nitrelatriacetic acid
(6) Cyclohexanediamine tetraacetic acid
(7) Iminodiacetic acid
(8) Dihydroxyethylglycine
(9) Ethyl ether diaminetetraacetic acid
(10) Glycol ether diaminetetraacetic acid
(11) Ethylenediaminetetrapropionic acid
(12) Phenylenediamine tetraacetic acid
(13) Ethylenediaminetetraacetic acid disodium salt
(14) Ethylenediaminetetraacetic acid tetra(trimethyl ammonium) salt
(15) Ethylenediaminetetraacetic acid tetrasodium salt
(16) Diethylenetriaminepentaacetic acid pentasodium salt
(17) Ethylenediamine-N-(β-oxyethyl)-N,N',N'-triacetic acid sodium salt
(18) Propylenediaminetetraacetic acid sodium salt
(19) Nitrilatriacetic acid sodium salt
(20) Cyclohexanediaminetetraacetic acid sodium salt In addition to various kinds of the bleaching agent mentioned above, the bleach-fixing solution used in the present invention may be incorporated, in special cases, with oxidative salts such as hydrogen peroxide, bromate, iodate, chlorate, perborate and nitrite.

As mentioned previously, processing baths into which the present polymer can be incorporated are the photographic processing bath having fixing ability and/or the post-treatment bath subsequent thereto. The most simple processing solution of the post-treatment bath is a solution incorporated with the present polymer (or copolymer) alone. This solution may be incorporated with acids such as an acetic acid, a phosphoric acid and a boric acid, and alkalis such as sodium hydroxide and sodium carbonate, and may be further incorporated, if necessary, with precipitation preventing agents comprising various kinds of chelate compounds, film hardening agents comprising various kinds of compounds including those of alum or aldehyde type, pH buffer agents, antioxidants such as sulfites, hydroxylamine and hydrazine, anti-swelling agents such as sodium sulfate and magnesium sulfate, defoaming agents and surface active agents.

Although there is no need usually for the processing bath used in the present invention to be incorporated with such compounds as referred to below and also no incorporation into said processing bath of said compounds is desirable, the processing bath may also be incorporated with small amounts of thiocyanate, thiosulfate, thioglycols, polyethylene glycols, thioureas, quaternary amine salts, aliphatic thiols such as a thioglyceral and aromatic thiols such as 5-amino-2-mercapta-1,3,4-thiadiazole, provided that the incorporation of these compounds is not detrimental to the effect of the present invention.

The process for the treatment of photographic materials according to the present invention encompasses all the processes for treating silver halide photographic materials including a step of processing said photographic material in the photographic processing bath having fixing ability. Typical examples of a preferred embodiment of the process of the present invention are those which involve the following various steps, but the present process is not limited only thereto (In the following steps, every bath marked □ is a bath incorporated with the present polymer, a bath used in the pretreatment step prior to the photographic processing bath having fixing ability is called "pre-bath" and a bath used in the post-treatment step is called "post-bath".).

1 Black-and-white development - [fixing] - water washing - stabilizing
2 Black-and-white development - fixing - [water washing] - stabilizing
3 Black-and-white development - fixing - [post-bath] - water washing - stabilizing
4 Black-and-white development - stopping - [fixing] - water washing
5 Black-and-white development - [film hardening fixing] - post-bath - water washing
6 Black-and-white development - [pre-bath] - [fixing] - water washing
7 Black-and-white first development - stopping - water washing - color development - bleaching - [fixing] - water washing - stabilizing
8 Pre-film hardening - neutralizing - black-and-white first development - stopping - water washing - color development - stopping - water washing - [bleach-fixing] - water washing - stabilizing
9 Black-and-white first development - stopping - water washing - color development - [bleach fixing] - [post-bath] - water washing - stabilizing
10 Black-and-white first development - stopping - fog bath - color development - bleaching - [fixing] - [post-bath] - water washing - stabilizing
11 Color development - [pre-bath] - [bleach fixing] - water washing - stabilizing
12 Color development - [bleach fixing] -water washing - stabilizing
13 Color development - bleach fixing - [post-bath] - water washing - stabilizing
14 Color development - bleach fixing - [water washing] - stabilizing
15 Color development - stopping - bleaching - [fixing] - water washing - stabilizing
16 Color development - bleaching - water washing - [fixing] - stabilizing
17 Special layer-removing bath - color development - [bleach fixing] - [post-bath] - water washing - stabilizing
18 Pre-film hardening - neutralizing - color development - bleaching - [pre-bath] - [fixing] - [post-bath] - water washing - stabilizing
19 Special layer - removing bath - water washing - black-and-white first development - water washing - red exposure - cyan color development - water washing - blue exposure - yellow color development - water washing - magenta color development - water washing - [bleach-fixing] - water washing - stabilizing Prior to application of the treatment process of the present invention, the photographic material to be treated may be subjected to development treatment which may be, according to the kind of photographic materials treated, black-and-white development, color development or black-and-white development in combination with color development. A black-and-white developer solution used in the above-mentioned black-and-white development step may be any of those, for example, known as the black-and-white first developer used in processing light-sensitive color photographic materials or any developer solution used in processing black-and-white photographic materials. This developer solution may also be incorporated with various additives commonly added to the black-and-white developer solution. Typical additives which may be incorporated into the black-and-white developer solution may include developing agents such as 1-phenyl-3-pyrazolidone, methol and hydroquinone, such constant state retaining agent as sulfite, promotors comprising alkali such as sodium hydroxide, sodium carbonate and potassium carbonate, inorganic or organic inhibitors such as potassium bromide, 2-methylbenzimidazole and methylbenzthiazole, such hard water softening agent as polyphosphate, and surface-over-development preventing agents comprising slight amounts of iodides and mercapto compounds.

The color developer solution used in the afore-mentioned step of color development may be any the developer solutions of all kinds used in color development treatment of light-sensitive color photographic materials. For example, an aqueous alkali solution containing an aromatic primary amine color developing agent is preferably used in the present invention. This aqueous alkali solution may be incorporated with pH regulators or pH buffer agents such as sodium hydroxide, sodium carbonate, sodium metaborate, sodium bicarbonate and boric acid and, in special cases, may further be incorporated with such foggants as tin chloride and borohydride and also with benzyl alcohol. The color developing agent includes, for example, N,N-diethyl-p-phenylenediamine sulfate, 4-amino-N-ethyl-N-$\beta$-hydroxyethylaniline sulfate, 3-methyl-4-amino-N-ethyl-$\beta$-methanesulfonamidoethylaniline sesquisulfate monohydrate, 3-methyl-4-amino-N-ethyl-N-$\beta$-hydroxyethylaniline sulfate and the like. The developer solution containing the above-mentioned color developing agent may also be incorporated with bromide, iodide, carbonate, bisulfite, known foggants, known development promotors and solvents such as diethylene glycols.

Photographic materials to which the present invention can be applied may be any of those so long as they are light-sensitive silver halide photographic materials, and the present invention may be effectively applicable also to treatment of high speed light-sensitive silver halide photographic materials including of course the treatment of low speed light-sensitive silver halide photographic materials. The present invention is applicable in common to treatment of light-sensitive silver halide photographic materials of all types which require fixing treatment thereof, for example, black-and-white or color light-sensitive materials for printing such as photographic printing paper and the like, and light-sensitive materials for photography such as negative black-and-white or color films and reversal black-and-white or color films and the like.

In case the photographic materials to which the present invention is applied are those for use in color photography, said materials may be either those of internal development type (as disclosed in U.S. Pat. Nos. 2,376,679 and 2,801,171), in which a coupler is contained in the photographic material, or those of external development type (as disclosed in U.S. Pat. Nos. 2,252,718, 2,592,243 and 2,590,970), wherein a coupler is contained in the developer solution used therefor. Couplers usable in the color photographic materials or color developer solutions to the present invention is applicable may be any of those which are generally known in the industry concerned. For example, such couplers include cyan couplers which are basically of naphthol or phenol structure and which form indoaniline dyes by coupling, magenta couplers which have as their backbone structure 5-pyrazolone ring having active methylene groups, and yellow couplers which are of benzoylacetanilide, pivalyacetanilide or acylacetanilide structure with active methylene groups and which having or not having substituents at the coupling positions. Thus, the present invention is applicable to any color photographic materials or color developer solutions containing any of the so-called 2-equivalent and 4-equivalent couplers.

Silver halide emulsions used in the photographic materials to which the present invention is applied may be any of those which contain any silver halide such as silver chloride, silver bromide, silver iodide, silver chlorobromide, silver chloroiodide, silver iodobromide or silver chloroiodobromide. Protective colloids for these silver halides may be those which are synthesized, including of course natural products such as gelatin and the like. The silver halide emulsions may of course contain ordinary photographic additives such as stabilizers, sensitizers, film hardeners, sensitizing dyes and surface active agents.

In the fixing solution of the photographic processing bath used in the present invention, silver ions dissolved therein can be readily recovered and, at the same time, and fixing solution is quite stable, and hence after recovering the silver ion, the fixing solution may be repeatedly used, if necessary, after enhancing its fixing ability by suitably adding thereto the aforesaid regenerating or replenishing agent. In recovering the silver ion, any of the known processes may be adoptable. Typical examples of the known processes include a silver precipitation process using a precipitating agent, an electrolytic process utilizing electrolysis, a metal substitution process utilizing ionization tendency, and an ion exchange process by means of ion exchange resins. Among these, the electrolytic process is preferably usable in the present invention from the standpoint of regeneration and re-use of the fixing solution. The above-mentioned silver recovering processes are disclosed, for example, in M. L. Sehreibe, "Present Status of Silver Recovery Motion Picture Laboratories", Vol. 74, 505–514 (1965).

Preferably, the above-mentioned known process for the recovery of the silver ion, through which the silver recovery from the photographic processing solution having fixing ability used in the present invention may be accomplished is accompanied by the following incidental operation. For example, in the case of the metal substitution process, the pH of the processing solution to be treated thereby is desirably lowered, because both bromine and iodine ions are adsorbed on the metal surface, thereby to act as inhibitors. In the case of the electrolytic process, it is desirable to vary the pH of the electrolyte, current density and/or revolving speed of the cathode, because halogen ions of the present invention are sometimes oxidized.

In case the photographic processing solution having fixing ability used in the present invention is a fixing solution, said solution may be re-used simply after recovering the silver ion therefrom. However, when the said processing solution is a bleach-fixing solution, it is preferable to carry out the recovery of silver ion simultaneously with oxidation of the reduced body of the bleaching agent to restore said body to the former state, i.e. an oxidizing agent. That is, the bleach-fixing solution effects bleach-oxidation of silver and simultaneously is, per se, subject to reduction, whereby the reduced body of the bleaching agent is formed and accumulated in the solution, and this causes the so-called fatigue phenomenon where the processing solution is reduced in its bleach-fixing ability. On the other hand, however, the bleach-fixing solution used in the present invention does not contain such fixing agent acting as a reducing agent as thiosulfate or the like which is oxidized at normal pH, and hence the reduced body formed at the time of treatment is only a reduced body of the bleaching agent. Thus, oxidation of the reduced bleaching agent formed at the time of treatment in the present invention may be effected by means of ordinary oxidizing agents. In the present invention, there may be employed various oxidizing processes, for example, a process by means of air, oxygen or ozone, a process by means of hydrogen peroxide, persulfate, chlorate, hypochlorite, bromate, nitrous acid, perborate, halogen gases or other inorganic or organic oxidizing agents, an anode oxidation process by means of electrolysis, and a process by means of oxidation-reductive resins of metal chelate, quinone or the like types.

According to the process of the present invention, there may be obtained a preventive effect on opacification of processed films and the like by virtue of addition of the present polymer, except for the prevention of public nuisance which is one of the objects of the present invention, even when thiocyanate is used in place of bromine or iodine ion used as a fixing agent in the present process. However, such use of thiocyanate as mentioned above is excluded from the scope of the present invention, because the use of thiocyanate has such drawbacks from the standpoint of regeneration and re-use that not only the burden of the biological oxygen demand and the chemical oxygen demand are made high and the possibility of environmental pollution is involved when thiocyanate is used but also there is a possibility that thiocyanate decomposes to release poisonous cyan, and further that thiocyanate is liable to influence the accumulation of halogen ion which is a fixing-inhibitory component.

In this respect, bromine or iodine ion used as a fixing agent in the present invention, as mentioned previously, is not affected by fixing-inhibitory components such as halogen ion which is eluted from emulsion layers or the like of the photographic material to be treated and accumulates in the photographic processing having fixing ability, thereby to accomplish the aforesaid objects of the present invention. That is, it has heretofore been a technically accepted idea that in case a halogen ion is eluted from the emulsion layer of the photographic material to be treated and accumulates in the photographic processing solution having fixing ability, the fixing ability of said solution is markedly hindered. Such inhibition of the fixing ability by the action of the halogen ion is disclosed in detail, for instance, in "Photographic Science & Engineering" Vol. 17, 174 (1973). In accordance with the present invention, however, it has been made possible to provide an excellent photographic treatment process which is not affected by the fixing-inhibitory component by virtue of the use as a fixing agent of a specific halogen ion in a specific concentration or more in the photographic processing solution having fixing ability as fully explained hereinbefore.

The present invention is illustrated below with reference to examples, but embodiments of the invention are not limited only to those examples.

EXAMPLE 1

A high speed silver iodobromide gelatinous emulsion containing 9 mol% of silver iodide was subjected to second ripening and then charged with 30 ml/mol $Ag_x$ of 3% saponin and 3 mg/g gelatin of mucochloric acid successively and finally with a gelatin solution. The resulting emulsion was coated in a proportion of 7.0 g $Ag/m^2$ on a cellulose triacetate film and then dried to prepare a sample. The sample was immersed, without exposure, into each of fixing solutions (a) through (i) having the following compositions to measure visually a clearing time within which the silver halide in the sample dissolves and the film becomes transparent. Thereafter, the sample was water-washed and then dried to measure its opacity (turbidity) using a turbidimeter (SEP-PL type manufactured by Nippon Seimitsu Kogaku K.K.).

Subsequently, fatigued fixing solutions (a) through (i) were obtained by effecting fixing treatment of about 50 cartridges, per liter of each of the fixing solutions (a) through (i), of a commercially available ordinary black-and-white film, Knipan SS 20-frame cartridge (product of Konishiroku Photo Industry Co. Ltd.). Using the thus obtained fatigued fixing solutions (a) through (i), the sample prepared as above was processed in the same manner as above to measure its clearing time and opacity in the same procedures as above.

On the other hand, after fixing treatment using the above-mentioned fatigued fixing solution (d) or (g), the sample was subjected to post-treatment using post-baths (j) through (m) having the following compositions to measure its opacity in the same procedure as above. The results obtained were as shown in Table 1 mentioned later.

In the case where the fresh fixing solutions were used, each treatment involved fixing for 5 minutes, water washing for 1 minute and drying at 80° C., while the treatment using the fatigued fixing solutions involved in each case fixing for 5 minutes, post-bath for 30 seconds, water washing for 1 minute and drying at 80° C. These treatments were carried out at 20° C., except for the drying temperature.

| | |
|---|---|
| Fixing solution (a) | |
| Ammonium thiosulfate | 120 g |
| Ammonium sulfite | 20 g |
| Water to make | 1 liter |
| Fixing solution (b) | |
| Ammonium thiosulfate | 90 g |
| Water to make | 1 liter |
| Fixing solution (c) | |
| Ammonium bromide | 450 g |
| Water to make | 1 liter |
| Fixing solution (d) | |
| Ammonium iodide | 250 g |
| Water to make | 1 liter |
| Fixing solution (e) | |
| Ammonium thiocyanate | 90 g |
| Exemplified polymer [1] *Note 1 | 20 g |
| Water to make | 1 liter |
| Fixing solution (f) | |
| Ammonium bromide | 450 g |
| Exemplified polymer [1] | 25 g |
| Water to make | 1 liter |
| Fixing solution (g) | |

-continued

| | |
|---|---|
| Ammonium iodide | 600 g |
| Exemplified polymer [1] | 25 g |
| Water to make | 1 liter |
| Fixing solution (h) | |
| Ammonium bromide | 500 g |
| Exemplified polymer [5] | 50 g |
| Water to make | 1 liter |
| Fixing solution (i) | |
| Ammonium iodide | 300 g |
| Exemplified polymer [20] | 7 g |
| Water to make | 1 liter |
| Post-bath (j) | |
| Boric acid | 30 g |
| Borax | 42 g |
| Polyacrylic acid monoethanolamine | 30 g |
| Water to make | 1 liter |
| Post-bath (k) | |
| Boric acid | 30 g |
| Borax | 42 g |
| Exemplified polymer [1] | 5 g |
| Water to make | 1 liter |
| Post-bath (l) | |
| Boric acid | 30 g |
| Borax | 42 g |
| Exemplified polymer [20] | 100 g |
| Water to make | 1 liter |
| Post-bath (m) | |
| Exemplified polymer [5] | 10 g |
| Water to make | 1 liter |

*Note 1:
The aforementioned commercially available product PVP-K30 was used.

Each of the above mentioned fixing solutions and post-baths was adjusted to pH 7.0 with ammonia water or glacial acetic acid.

longed though not to such an extent as in the case of the fixing solution (a).

In contrast, in the case of treatments (Nos. 6–9) in accordance with the present invention where the fixing solutions (f)–(i) incorporated with bromide or iodide as a fixing agent together with the present polymers (or copolymers) were used, both the clearing times measured by the use of fresh solutions and fatigued solutions are short and the difference therebetween is small, and hence it is understood that the present fixing solutions are suitable for regeneration and repeated re-use and the finished films processed thereby are quite excellent in transparency.

It is understood that even in the case of treatments (Nos. 11–14) in accordance with the present invention where the post baths incorporated with the present polymers (or copolymers) were used, the finished films are favorable in transparency and also the difference in clearing time is small between the use of fresh fixing solutions and that of the fatigued fixing solutions. In the case of treatment (No. 10) where the post-bath (j) incorporated with a comparative compound in place of the present polymer (or copolymer) was used, it is understood that there is brought about such drawback that the bath is poor in transparency and the finished film obtained becomes markedly opaque.

In the above-mentioned treatment (No. 12) in accordance with the present invention, the film was coated with the post-bath (1) using a sponge, whereby an effect Table 1

| Treatment No. | Processing bath: Fixing solution | Processing bath: Post-bath | Fresh processing solution: Clearing time [sec.] | Fresh processing solution: Turbidity [%] *Note 1 | Fresh processing solution: Transparency *Note 2 | Fatigued processing solution: Clearing time [sec.] | Fatigued processing solution: Turbidity (%) | Fatigued processing solution: Transparency |
|---|---|---|---|---|---|---|---|---|
| 1 | (a) | none | 90 | 0 | Good | 260 | 0 | Good |
| 2 | (b) | " | 76 | 1.5 | Bad | 210 | 16 | Bad |
| 3 | (c) | " | 86 | 2.0 | " | 99 | 12 | " |
| 4 | (d) | " | 67 | 3.0 | " | 81 | 21 | " |
| 5 | (e) | " | 74 | 0 | Good | 160 | 0 | Good |
| 6 | (f) | " | 82 | 0 | " | 96 | 0 | " |
| 7 | (g) | " | 54 | 0 | " | 56 | 0 | " |
| 8 | (h) | " | 79 | 0 | " | 90 | 0 | " |
| 9 | (i) | " | 61 | 0 | " | 76 | 0 | " |
| 10 | (d) | (j) | 67 | 3.0 | Bad | 81 | 21 | Bad |
| 11 | (d) | (k) | 67 | 0 | Good | 81 | 0 | Good |
| 12 | (d) | (l) | 67 | 0 | " | 81 | 0 | " |
| 13 | (d) | (m) | 67 | 0 | " | 81 | 0 | " |
| 14 | (g) | (m) | 54 | 0 | " | 56 | 0 | " |

*Note 1.
Opacification of the sample due to deposition of precipitates of insoluble silver salt during the water-washing step after the fixing treatment was expressed in terms of %.
*Note 2.
In judging opacity of the finished film, the film which became opaque even slightly was graded "Bad" and graded "Good" when no opacification was observed.

As is clear from the results shown in Table 1, in the case of treatment (No. 1) using the fixing solution (a) comprising thiosulfate as a fixing agent, there is observed such a drawback that the clearing time by the use of the fatigued fixing solution is greatly prolonged though the finished film is favorable in transparency. In the case of treatments (Nos. 2–4) using the fixing solutions (b)–(d) other than those of the present invention, there is observed such a drawback that when thiocyanate, bromide and iodide are used as fixing agents, the finished film becomes opaque and particularly the finished film processed by the fatigued fixing solution becomes markedly opaque. In the case of treatment (No. 5) which is not in accordance with the present treatment process where the fixing solution (e) containing the present polymer was used, it is understood that although the finished film is favorable in transparency, nevertheless the clearing time is considerably prosimilar to that obtained in the treatment (No. 12) was obtained.

When the treatments (Nos. 6–9 and 11–14) in accordance with the present invention were individually conducted at the treatment temperatures of 38° C. and 55° C., favorable results were likewise obtained with respect to the transparency. In the case where the treatment temperature employed was 38° C., the clearing times as measured in each case by the use of the fresh fixing solution and of the fatigued solution were shorter than those obtained in the treatments conducted at 20° C. Particularly, there was also obtained such better result that the difference becomes small between the clearing times as measured by the use of the fresh solution and of the fatigued solution. In the case where the treatment temperature employed was 55° C., the above-mentioned tendencies were more markedly observed, and this indicates that in the treatment process according to the present invention, the higher is the temperature within the treatment temperature range, the better are the results.

Treatments similar to those of this example were conducted, except that the fixing solutions and the post-baths were adjusted to pH 4.0 and pH 8.6, respectively, to find that the treatments in accordance with the present invention gave favorable results with respect to clearing time as well as to transparency of the finished film.

EXAMPLE 2

A high speed silver iodobromide gelatinous emulsion containing 9.5 mol% of silver iodide was subjected to second ripening and then charged in the following order with photographic additives as illustrated below to obtain a red-sensitive emulsion.

(1) An additive as prepared by forming a mixture having the following composition by means of a high speed rotary mixer into a coupler dispersion and adding the coupler dispersion to an emulsion containing 1 mole of a silver halide.

| | | | |
|---|---|---|---|
| | 1-Hydroxy-2-[α-(2', 4'-di-t-amyl-phenoxybutyl)]-naphthamide | 48 | g |
| | Tricresyl phosphate | 20 | g |
| | Ethyl acetate | 140 | g |
| | 3% Gelatin | 700 | ml |
| | 5% Sodium dodecylbenzenesulfonate | 100 | ml |
| (2) | 3% Saponin | 95 ml/mol | Agx |
| (3) | 0.5% Mucochloric acid | 80 ml/mol | Agx |

Subsequently, the thus obtained red-sensitive emulsion was charged with a 10% aqueous gelatin solution, and the resulting emulsion was coated in a proportion of 2.0 g Ag/m$^2$ on a cellulose triacetate film and then dried to obtain a sample. The sample thus obtained was exposed to a definite amount of light through an optical wedge according to an ordinary procedure and then subjected to the following treatments:

| | [Treatment] | (Treatment temperature: 38° C) | |
|---|---|---|---|
| (1) | Color development | 3 minutes | 15 seconds |
| (2) | Bleaching | 6 minutes | 30 seconds |
| (3) | Water-washing | 3 minutes | 15 seconds |
| (4) | Fixing | 6 minutes | 30 seconds |
| (5) | Water-washing | 3 minutes | 15 seconds |
| (6) | Stabilizing | 1 minute | 30 seconds |

Except the fixing solution, the processing solutions individually used had the following composition:

| | | |
|---|---|---|
| Color developer solution: | | |
| 4-Amino-3-methyl-N-ethyl-N-(β-hydroxyethyl)aniline sulfate | 4.8 | g |
| Anhydrous sodium sulfite | 0.14 | g |

-continued

| | | |
|---|---|---|
| Hydroxylamine ½ sulfate | 1.98 | g |
| Sulfuric acid | 0.74 | mg |
| Anhydrous potassium carbonate | 28.85 | g |
| Anhydrous potassium bicarbonate | 3.46 | g |
| Anhydrous potassium sulfite | 5.10 | g |
| Potassium bromide | 1.16 | g |
| Sodium chloride | 0.14 | g |
| Trisodium nitrilatriacetate (monohydrate) | 1.20 | g |
| Potassium hydroxide | 1.48 | g |
| Water to make | 1 | liter |
| Bleaching solution: | | |
| Ethylenediaminetetraacetic acid iron (III) ammonium salt | 100 | g |
| Ethylenediaminetetraacetic acid diammonium salt | 10 | g |
| Ammonium bromide | 150 | g |
| Glacial acetic acid | 10 | ml |
| Water to make | 1 | liter |
| Adjusted to pH 6.0 by means of ammonia water. | | |
| Stabilizing solution: | | |
| Formalin (37.5% aqueous solution) | 15 | ml |
| 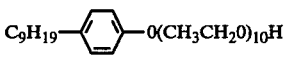 | 1 | g |
| Water to make | 1 | liter |

As the fixing solutions, there were used the fixing solutions (a) through (i) of Example 1.

The aforementioned sample was cut into pieces of 320 cm$^2$ each in size and also into pieces of 4.8 m$^2$ each in size (the latter piece corresponds to 150 pieces of the former), and the resulting samples were individually subjected to the above-mentioned treatment. In the same procedure as in Example 1, each fixing solution was measured in clearing time by visual observation through the back side of the film and further unexposed areas of the processed film were measured in turbidity (opacity) to obtain the results as shown in the following Table 2.

Table 2

| Treatment No. | Fixing solution | Fresh fixing solution: Clearing time [sec.] | Turbidity [%] | Transparency | Fatigued fixing solution after processing film of 4.8 m$^2$: Clearing time [sec.] | Turbidity [%] | Transparency |
|---|---|---|---|---|---|---|---|
| 15 | (a) | 58 | 0 | Good | 142 | 0 | Good |
| 16 | (b) | 42 | 1.0 | Bad | 114 | 17 | Bad |
| 17 | (c) | 47 | 2.4 | " | 52 | 21 | " |
| 18 | (d) | 38 | 5.2 | " | 41 | 32 | " |
| 19 | (e) | 44 | 0 | Good | 110 | 0 | Good |
| 20 | (f) | 44 | 0 | " | 51 | 0 | " |
| 21 | (g) | 29 | 0 | " | 30 | 0 | " |
| 22 | (h) | 45 | 0 | " | 49 | 0 | " |
| 23 | (i) | 31 | 0 | " | 34 | 0 | " |

As is clear from the results shown in Table 2, it is understood that in the treatments (Nos. 20–23) in accordance with the present invention, even though the photographic material treated thereby was a high speed color photographic material, the clearing times as measured are found favorable, particularly the clearing time by the use of the fatigued solution does not differ widely from that by the use of the fresh solution and the finished film obtained thereby is excellent in transparency.

When the above-mentioned experiments were repeated, except that a polyethylene-laminated paper was used as a support in the aforementioned sample in place of the cellulose triacetate film support, better results were obtained likewise in the case of the treatments in accordance with the present invention. In contrast thereto, however, in the case of the treatments (Nos. 15–19) not in accordance with the present invention, deposition of white adherents was observed on the emulsion surface and poor transparency of the finished film was confirmed even by visual observation of the formed dye image by means of reflecting light.

The above-mentioned treatments of this example were repeated, except that a post-bath treatment for 1 minute was interposed between the fixing step (4) and the water-washing step (5), namely, after treatment with the fixing solution (d) of Example 1, treatments using the post-baths (k), (l) and (m) were conducted, whereby better results were likewise obtained in the case of treatments in accordance with the present invention.

The treatments of this examples were also conducted at the treatment temperature of 50° C., to find that in the case of the treatments in accordance with the present invention, better results were obtained showing a small difference in clearing time between the use of the fresh solution and that of the fatigued solution. The same treatments of this example were repeated but adjusting the fixing solution and the post-bath to pH 4.0 and 8.6, respectively, whereby better results were obtained in the case of the treatments in accordance with the present invention with respect to clearing time as well as to transparency of the finished film.

EXAMPLE 3

On a cellulose triacetate film support which had been subjected to subbing treatment were coated successively the following layers to prepare a negative light-sensitive silver halide color photographic material.

(1) Antihalation layer

A black colloid silver was dispersed in an aqueous gelatin solution to prepare a dispersion. The dispersion was coated on the support in proportions of 3 g/m$^2$ of gelatin and 0.3 g/m$^2$ of silver.

(2) Cyan-forming red-sensitive silver halide emulsion layer

A silver iodobromide gelatinous emulsion (containing 6 mol% of silver iodide) was dispersed in an aqueous gelation solution containing a tricresyl phosphate solution of a mixture comprising 5 g of colored cyan coupler (I) and 20 g of cyan coupler (II), and the resulting emulsion was coated on the layer (1) in proportions of 4.5 g/m$^2$ of gelatin, 3.4 g/m$^2$ of silver and 1.4 g/m$^2$ of cyan coupler.

(3) Intermediate layer

An aqueous gelatin solution was coated on layer (2) in a proportion of 1.3 g/m$^2$ of gelatin.

(4) Magenta-forming green-sensitive silver halide emulsion layer

A silver iodobromide gelatinous emulsion (containing 6 mol% of silver iodide) was dispersed in an aqueous gelatin solution containing a tricresyl phosphate solution of a mixture comprising 5 g of colored magenta coupler (III) and 25 g of magenta coupler (IV), and the resulting emulsion was coated on layer (3) in proportions of 5.0 g/m$^2$ of gelatin, 3.2 g/m$^2$ of silver and 1.2 g/m$^2$ of magenta coupler.

(5) Intermediate layer

An aqueous gelatin solution was coated on layer (4) in a proportion of 1.3 g/m$^2$.

(6) Yellow filter layer

A yellow colloid silver was dispersed in an aqueous gelatin solution, and the resulting dispersion was coated on layer (5) in proportions of 0.1 g/m$^2$ of silver and 1.3 g/m$^2$ of gelatin.

(7) Yellow-forming blue-sensitive silver halide emulsion layer

A silver iodobromide gelatinous emulsion (containing 7 mol% of silver iodide) dispersed in an aqueous gelatin solution containing a dibutyl phthalate solution of 30 g of yellow coupler (V) was coated on the layer (6) in proportions of 4.0 g/m$^2$ of gelatin, 1.0 g/m$^2$ of silver and 1.6 g/m$^2$ of yellow coupler.

(8) Protective layer

An aqueous gelatin solution was coated on layer (7) in a proportion of 1.3 g/m$^2$.

Into each of the above layers, 1,2-bis(vinylsulfonyl)ethane is added in an amount of 20 m/g gelatin, as a hardening agent.

The couplers used were as follows:

(I) Colored cyan coupler

1-Hydroxy-4-[4-(2-hydroxy-3,6-disulfo-1-naphthylazo)anilinocarbonyloxy]-N-[α-(2,4-di-t-amylphenoxy)butyl]-2-naphthoamide disodium salt

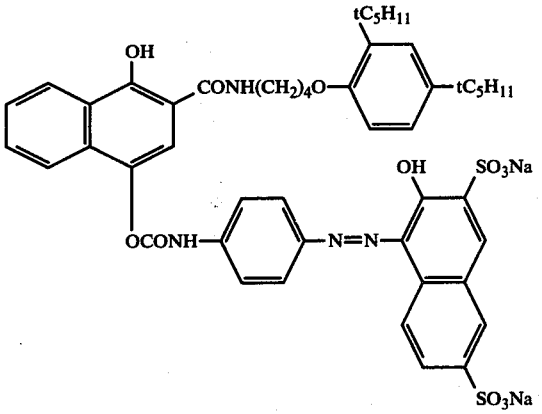

(II) Cyan coupler

2-{4-(2,4-di-t-Amylphenoxy)butyl}carbamoyl-1-naphthol

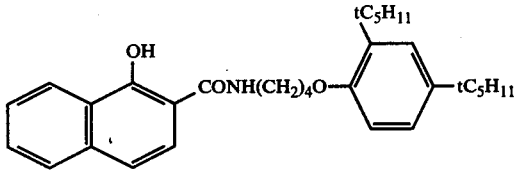

(III) Colored magenta coupler 3-(2-Chloro-5-octadecylsuccinimido-anilino)-1-(2,4,6-trichlorophenyl)-4-(1-naphthylazo)-5-pyrazolone

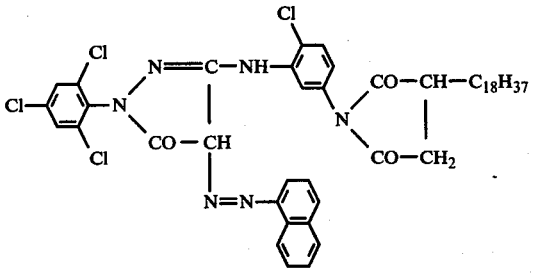

(IV) Magenta coupler 1-(2,4,6-Trichlorophenyl)-3-(3-octadecylsuccinimidobenzamido)-b 5-pyrazolone

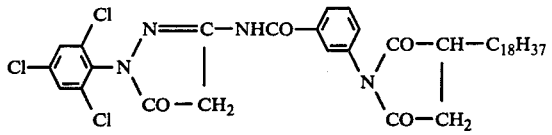

(V) Yellow coupler
α-Succinimido-α-pivalyl-6-chloro-5-[γ-(2,4-di-t-amylphenoxy)butyramido]acetanilide

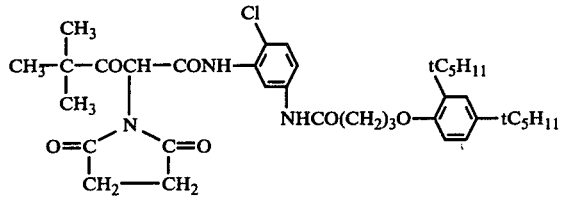

The sample obtained was exposed to a given amount of light according to an ordinary procedure through an optical wedge and then subjected to the following treatment:

| [Treatment] | | (Treatment temperature: 38° C) | |
|---|---|---|---|
| (1) | Color development | 3 minutes | 15 seconds |
| (2) | Bleach-fixing | 6 minutes | |
| (3) | Water-washing | 3 minutes | 15 seconds |
| Color developer solution | | The same as in Example 2. | |
| [Bleach-fixing solution] | | | |

-continued

| | | |
|---|---|---|
| Fixing solution (f) | | |
| Bleach-fixing solution (r) | | |
| The above-mentioned bleaching agent | | |
| Fixing solution (g) | | |
| Bleach-fixing solution (a) | | |
| The above-mentioned bleaching agent | | |
| Fixing solution (i) | | |
| Bleach-fixing solution (t) | | |
| Potassium ferricyanide | 40 | g |
| Fixing solution (g) | | |
| Bleach-fixing solution (u) | | |
| Sodium persulfate | 90 | g |
| Fixing solution (h) | | |

The above-mentioned bleach-fixing solutions (n) through (t) were adjusted to pH 6.2 by means of ammonia water or glacial acetic acid, and the bleach-fixing solution (u) was adjusted to pH 11.0 by means of sodium hydroxide.

The aforesaid sample was cut into pieces of 320 $cm^2$ each in size and also into pieces of 1.6 $m^2$ each in size (the latter piece corresponds to 50 pieces of the former), and the resulting samples were individually subjected to the above-mentioned treatments. In the same procedure as in Example 1, each bleach-fixing solution was measured in clearing time by visual observation through the back side of the film and further unexposed areas of the processed film were measured in turbidity to obtain the results as shown in the following Table 3.

Table 3

| Treatment No. | Bleach-fixing solution | Fresh bleach-fixing solution: Clearing time [sec.] | Turbidity [%] | Transparency | Fatigued bleach-fixing solution after processing film of 1.6 $m^2$: Clearing time [sec.] | Turbidity [%] | Transparency |
|---|---|---|---|---|---|---|---|
| 24 | (n) | More than 6 minutes *Note 1 | 0 | Good | More than 6 minutes *Note 1 | 0 | Good |
| 25 | (o) | 130 | 5.6 | Bad | 160 | 37 | Bad |
| 26 | (p) | 90 | 9.7 | " | 95 | 49 | " |
| 27 | (q) | 125 | 0 | Good | 150 | 0 | Good |
| 28 | (r) | 90 | 0 | " | 100 | 0 | " |
| 29 | (s) | 90 | 0 | " | 95 | 0 | " |
| 30 | (t) | 65 | 0 | " | 70 | 0 | " |
| 31 | (u) | 110 | 0 | " | 140 | 0 | " |

*Note 1.
No bleach-fixing attained by the treatment conducted for 6 minutes.

The bleach-fixing solutions used in this example were prepared by adding the following bleaching agent and other agents to 1 liter of each of the fixing solutions used in Example 1.

| | | |
|---|---|---|
| **Bleaching agent:** | | |
| Ethylenediaminetetraacetic acid iron [III] ammonium salt | 100 | g |
| Ethylenediaminetetraacetic acid ammonium salt | 10 | g |
| Bleach-fixing solution (n) | | |
| The above-mentioned bleaching agent | | |
| Fixing solution (a) | | |
| Bleach-fixing solution (o) | | |
| The above-mentioned bleaching agent | | |
| Fixing solution (c) | | |
| Bleach-fixing solution (p) | | |
| The above-mentioned bleaching agent | | |
| Fixing solution (d) | | |
| Bleach-fixing solution (q) | | |
| The above-mentioned fixing agent | | |

As is clear from the results shown in Table 3, it is understood that in the treatments (Nos. 27–31) in accordance with the present invention, even though the photographic material to be treated thereby is a negative light-sensitive silver halide color photographic material of high silver content, the clearing time is short, particularly the clearing time by the use of the fatigued solution scarcely increases, and the finished film is excellent in transparency.

The treatments of this example were repeated, except that a post-bath treatment for 30 seconds was interposed between the bleach-fixing step (2) and the water-washing step (3), namely, after the treatment with the above-mentioned bleach-fixing solution (o), treatments with the post-baths (k), (l) and (m) were conducted, whereby favorable results were likewise obtained in the case of the treatments in accordance with the present invention. In the case where the above post-bath treatment was conducted by the coating process with a sponge, better results were similarly obtained in the case of the treatment in accordance with the present invention.

Further, even the treatment temperature of 50° C. was employed in this example, very good results were obtained in the case of the treatments in accordance with the present invention where no substantial was observed in clearing time between the use of the fresh solution and that of the fatigued solution.

Furthermore, the treatments of this example in accordance with the present invention were conducted while adjusting the bleach-fixing solution to pH 5.5 and 7.6, respectively, whereby there were obtained favorable results in the case of pH 7.6 with regard to transparency of the film though the clearing time as measured was found to be somewhat longer than those in this example, whereas in the case of pH 5.5 there were obtained such quite good results that the difference in clearing time between the use of the fresh solution and that of the fatigued solution is quite small as compared with the case of this example.

Further, it was confirmed that a dye image formed on the film processed by the treatment process of the present invention is not only free from degradation in photographic properties such as developed color density and property of retaining the straight line zone on the characteristic curve but also quite excellent, per se, in preservative stability.

EXAMPLE 4

A cyan-forming red-sensitive silver halide emulsion prepared by mixing, under emulsification, a red-sensitive silver iodobromide emulsion containing 9 mol% of silver iodide with a cyan coupler, 5-[α-(2,4-di-t-acyloxy)hexamido]-2-(α,α,β,β-tetrafluoropropionamido)-phenol was coated on a subbed polyethylene terephthalate film support in a proportion of 2 g/m$^2$ of silver. On the layer thus formed on the support was then coated a magenta-forming green-sensitive silver halide emulsion prepared by mixing, under emulsification, a green-sensitive silver iodobromide emulsion containing 8 mol% of silver iodide with a magenta coupler, 1-(2',4',6'-trichlorophenyl)-3''-[3''-(2'',4''-di-t-amylphenoxyacetamido)-benzamido]-5-pyrazolone, in a proportion of 2.0 g/m$^2$ of silver. On the layer thus formed was further coated a yellow-forming blue-sensitive silver halide emulsion prepared by mixing, under emulsification, a blue-sensitive silver iodobromide emulsion containing 7 mol% of silver iodide with a yellow coupler, α-benzoyl-[2-chloro-5-α-(dodecyloxycarbonyl)-propyloxycarbonyl]acetanilide, in a proportion of 2.0 g/m$^2$ of silver. Thus, there was prepared a sample (covering an area of 320 cm$^2$) of a reversal silver halide color photographic material.

The sample thus obtained was exposed to a given amount of light according to an ordinary procedure through an optical wedge and then subjected to the following treatments.

| | [Treatment] | (Threatment temperature: 38° C) | |
|---|---|---|---|
| (1) | Pre-film hardening | 2 minutes | 30 seconds |
| (2) | Neutralizing | | 30 seconds |
| (3) | First developing | 3 minutes | |
| (4) | First stopping | | 30 seconds |
| (5) | Water-washing | 1 minute | |
| (6) | Color developing | 3 minutes | 30 seconds |
| (7) | Second stopping | | 30 seconds |
| (8) | Bleach-fixing | 10 minutes | |
| (9) | Water-washing | 2 minutes | |

Except for the bleach-fixing solution, the processing solutions employed in this example had individually the following composition.

| | |
|---|---|
| Pre-film hardening solution | |
| Formalin (37% aqueous solution) | 20 ml |
| Sulfuric acid | 2 ml |
| Sodium sulfate | 100 g |
| Potassium sulfate | 2 g |
| Borax | 5 g |
| Water to make | 1 liter |
| Neutralizing solution | |
| Potassium bromide | 20 g |
| Glacial acetic acid | 10 ml |
| Sodium sulfate | 50 g |
| Sodium hydroxide | 6 g |
| Glycine | 10 g |
| Water to make | 1 liter |
| First developer solution | |
| Sodium hexametaphosphate | 1.0 g |
| 1-Phenyl-3-pyrazolidone | 0.3 g |
| Sodium sulfite | 50 g |
| Hydroquinone | 6.0 g |
| Sodium carbonate (monohydrate) | 35 g |
| Potassium bromide | 20 g |
| Potassium thiocyanate | 1.0 g |
| Potassium iodide (0.1 aqueous solution) | 10 ml |
| Water to make | 1 liter |
| First & second stopping solution | |
| Glacial acetic acid | 15 ml |
| Sodium acetate | 3 g |
| Water to make | 1 liter |
| Color developer solution | |
| Sodium hexamethaphosphate | 1.0 g |
| Benzyl alcohol | 6.0 ml |
| Sodium sulfite | 5.0 g |
| Sodium phosphate tribasic-12$H_2O$ | 40 g |
| Potassium bromide | 0.2 g |
| Potassium iodide (0.1% aqueous solution) | 10 ml |
| Sodium hydroxide | 6.5 g |
| Tert-butylamineborohydride | 0.09 g |
| 4-Amino-3-methyl-N-ethyl-N-methanesulfonamidoethylaniline sulfate | 10 g |
| Ethylenediamine | 8.0 ml |
| Water to make | 1 liter |

The bleach-fixing solutions used herein were the bleach-fixing solutions (n) through (u) of Example 3.

In the same procedure as in Example 1, the clearing time of each bleach-fixing processing solutions was visually measured through the back side of the film, and also the finished film was measured in turbidity to obtain the results as shown in the following Table 4.

Table 4

| Treatment No. | Bleach-fixing solution | Fresh bleach-fixing solution: Clearing time [sec.] | Turbidity [%] | Transparency | Fatigued processed solution after processing film of 1.6 m$^2$: Clearing time [sec.] | Turbidity [%] | Transparency |
|---|---|---|---|---|---|---|---|
| 32 | (n) | More than 6 minutes *Note 1 | 0 | Good | More than 6 minutes *Note 1 | 0 | Good |
| 33 | (o) | 310 | 1.6 | Bad | 340 | 14 | Bad |
| 34 | (p) | 200 | 2.9 | " | 220 | 23 | " |
| 35 | (q) | 300 | 0 | Good | 325 | 0 | Good |
| 36 | (r) | 195 | 0 | " | 195 | 0 | " |
| 37 | (s) | 190 | 0 | " | 195 | 0 | " |
| 38 | (t) | 160 | 0 | " | 160 | 0 | " |

Table 4-continued

| Treatment No. | Bleach-fixing solution | Fresh bleach-fixing solution | | | Fatigued processed solution after processing film of 1.6 $m^2$ | | |
|---|---|---|---|---|---|---|---|
| | | Clearing time [sec.] | Turbidity [%] | Transparency | Clearing time [sec.] | Turbidity [%] | Transparency |
| 39 | (u) | 200 | 0 | " | 210 | 0 | " |

*Note 1.
No bleach-fixing was attained by the treatment conducted for 6 minutes.

As is clear from the results shown in Table 4, it is understood that in the case of the treatments (Nos. 35–39) in accordance with the present invention where even though the photographic material to be processed thereby is a color reversal light-sensitive silver halide photographic material, the clearing times as measured were favorable, compared with the case of the treatments not in accordance with the present invention where the comparative bleach-fixing solutions (n) through (p) were used, and particularly the clearing time measured by the use of the fatigued solution is not widely different from that measured by the use of the fresh solution and, at the same time, transparency of the finished film was excellent.

After the bleach-fixing treatment (No. 34) in accordance with the present invention out of the treatments of this example, post-treatments were conducted (each for 1 minute 30 seconds) with the post-baths (k), (l) and (m) of Example 1 to find that the clearing times as measured were substantially equal to those of the case of the treatment No. 34 and, moreover, transparency of the finished film was excellent. When this post-treatment was conducted by the sponge-coating process using a sponge, favorable results were likewise contained.

Further, the treatments in accordance with the present invention in this example were conducted at the treatment temperature of 50° C., whereby quite excellent results were obtained, showing that the clearing time measured in the case of using the fresh solution did not substantially differ from that measured in the case of using the fatigued solution.

Furthermore, in the present example the treatments in accordance with the present invention were conducted while adjusting the bleach-fixing solution to pH 5.5 and 7.6, respectively, whereupon there were obtained quite excellent results showing that the lower is the pH of the bleach-fixing solution, the smaller becomes the difference in clearing time between the cases of using the fresh solution and of using the fatigued solution, as shown in Example 3.

What we claim is:

1. In a method comprising developing an imagewise exposed silver halide photographic material, processing the developed silver halide photographic material with a liquid photographic processing bath having fixing ability or with said liquid photographic processing bath and a liquid post-treatment bath subsequent thereto and waterwashing the processed silver halide photographic material, the improvement which comprises said photographic processing bath containing at least 3 moles/liter of bromine ion or at least 1.3 moles/liter of iodine ion, as the sole fixing agent at least one of said photographic processing bath and said post-treatment bath containing a polymer having, in the molecular structure, pyrrolidone nucleus units and a molecular weight of about 2,000 to 500,000, said polymer being present in said photographic processing bath in an amount of 5 to 200 grams per liter or in said post-treatment bath in an amount of 5 to 400 grams per liter.

2. A method according to claim 1 wherein the photographic processing bath is a fixing bath or a bleach-fixing bath.

3. A method according to claim 1 wherein the photographic processing bath is a bleach-fixing bath containing, as a bleaching agent, a metal complex salt of an organic acid.

4. A method according to claim 3 wherein the organic acid is an aminopolycarboxylic acid.

5. A method according to claim 1 wherein the content of the bromine ion in the photographic processing bath is 4–6 moles/liter.

6. A method according to claim 1 wherein the content of the iodine ion in the photographic processing bath is 1.5–6 moles/liter.

7. A method according to claim 1 wherein the photographic processing bath contains both the bromine ion and the iodine ion, either the content of the bromine ion being 4–6 moles/liter or the content of the iodine ion being 1.5–6 moles/liter.

8. A method according to claim 1 wherein the amount of the polymer in the photographic processing solution is 5–200 g/l.

9. A method according to claim 1 wherein the amount of the polymer in the post-treatment bath is 20–200 g/l.

10. A method according to claim 1 wherein the pH value of the photographic processing bath is 4–9.

* * * * *